US011139555B2

(12) United States Patent
Choi et al.

(10) Patent No.: US 11,139,555 B2
(45) Date of Patent: Oct. 5, 2021

(54) FILM ANTENNA AND DISPLAY DEVICE INCLUDING THE SAME

(71) Applicants: DONGWOO FINE-CHEM CO., LTD., Jeollabuk-do (KR); KREEMO INC., Seoul (KR)

(72) Inventors: Byung Jin Choi, Gyeonggi-do (KR); Jong Min Kim, Gyeonggi-do (KR); Yoon Ho Huh, Seoul (KR); Won Bin Hong, Seoul (KR)

(73) Assignees: DONGWOO FINE-CHEM CO., LTD, Jeollabuk-Do (KR); KREEMO INC., Seoul (KR)

( * ) Notice: Subject to any disclaimer, the term of this patent is extended or adjusted under 35 U.S.C. 154(b) by 0 days.

(21) Appl. No.: 16/865,682

(22) Filed: May 4, 2020

(65) Prior Publication Data

US 2020/0266526 A1 Aug. 20, 2020

Related U.S. Application Data

(63) Continuation of application No. PCT/KR2018/013342, filed on Nov. 6, 2018.

(30) Foreign Application Priority Data

Nov. 6, 2017 (KR) ..... 10-2017-0146686
Jan. 18, 2018 (KR) ..... 10-2018-0006540

(51) Int. Cl.
*H01Q 1/24* (2006.01)
*H01Q 1/38* (2006.01)
*H01Q 9/04* (2006.01)

(52) U.S. Cl.
CPC ..... *H01Q 1/243* (2013.01); *H01Q 1/38* (2013.01); *H01Q 9/0407* (2013.01)

(58) Field of Classification Search
CPC ..... H01Q 1/243; H01Q 1/38; H01Q 9/0407
(Continued)

(56) References Cited

U.S. PATENT DOCUMENTS

2005/0206609 A1* 9/2005 Yamamoto ..... G06F 3/147 345/104
2010/0013714 A1* 1/2010 Azhari ..... H01Q 1/243 343/700 MS (Continued)

FOREIGN PATENT DOCUMENTS

JP 11-177336 A 7/1999
JP 2017-175540 A 9/2017

(Continued)

OTHER PUBLICATIONS

International Search Report for PCT/KR2018/013342 dated Mar. 7, 2019.

(Continued)

*Primary Examiner* — Ted M Wang
(74) *Attorney, Agent, or Firm* — The PL Law Group, PLLC

(57) ABSTRACT

A film antenna according to an embodiment of the present invention includes a dielectric layer, an antenna pattern including a mesh structure on a top surface of the dielectric layer, and a dummy pattern on a top surface of the dielectric layer. The dummy pattern includes the same mesh structure as that of the antenna pattern. Optical properties are improved by the same mesh structure of the antenna pattern and the dummy pattern.

20 Claims, 10 Drawing Sheets

(58) Field of Classification Search
USPC ..... 455/575
See application file for complete search history.

(56) References Cited

U.S. PATENT DOCUMENTS

| | | | | |
|---|---|---|---|---|
| 2016/0190678 | A1* | 6/2016 | Hong | H01Q 1/273<br>343/700 MS |
| 2020/0203830 | A1* | 6/2020 | Tsuchiya | H01Q 21/30 |

FOREIGN PATENT DOCUMENTS

| | | | |
|---|---|---|---|
| KR | 10-2003-0095557 | A | 12/2003 |
| KR | 10-1025054 | B1 | 3/2011 |
| KR | 10-2016-0027446 | A | 3/2016 |
| KR | 10-2016-0080444 | A | 7/2016 |
| KR | 10-2016-0148349 | A | 12/2016 |
| WO | WO 2006/106759 | A1 | 10/2006 |

OTHER PUBLICATIONS

Office action dated Jun. 1, 2021 from Japan Intellectual Property Office in a counterpart Japanese Patent Application No. 2020-524277 (English translation is also submitted herewith.).

* cited by examiner

FILM ANTENNA AND DISPLAY DEVICE INCLUDING THE SAME

CROSS REFERENCE TO RELATED APPLICATIONS AND CLAIM OF PRIORITY

The present application is a continuation application to International Application No. PCT/KR2018/013342 with an International Filing Date of Nov. 6, 2018, which claims the benefit of Korean Patent Applications No. 10-2017-0146686 filed on Nov. 6, 2017 and No. 10-2018-0006540 filed on Jan. 18, 2018.

BACKGROUND

1. Field

The present invention relates to a film antenna and a display device including the same. More particularly, the present invention relates to a film antenna including an electrode and a dielectric layer and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

Mobile communication technologies have been rapidly developed, an antenna capable of operating a high-frequency or ultra-high frequency communication is needed in the display device. Further, as thin-layered display devices with high transparency and resolution such as a transparent display device, a flexible display device, etc., have been developed recently, development of the antenna having improved signaling sensitivity and radiation property and also having high transparency is also required.

To improve a signaling property of the antenna, an electrode or a radiation pattern formed of a low resistance metal may be advantageous. In this case, the electrode or the radiation pattern may be visually recognized by a user and may degrade an image quality of the display device.

SUMMARY

According to an aspect of the present invention, there is provided a film antenna having improved optical properties.

According to an aspect of the present invention, there is provided a display device including a film antenna with improved optical properties and having improved image quality.

The above aspects of the present invention will be achieved by one or more of the following features or constructions:

(1) A film antenna, including: a dielectric layer; an antenna pattern including a mesh structure on a top surface of the dielectric layer; and a dummy pattern on a top surface of the dielectric layer, the dummy pattern including the same mesh structure as that of the antenna pattern.

(2) The film antenna according to the above (1), wherein the dummy pattern includes a dummy line, and the antenna pattern includes a conductive line, wherein the dummy line and the conductive line have the same width and the same height.

(3) The film antenna according to the above (2), wherein the dummy line includes a first dummy line and a second dummy line which extend in different directions to intersect each other, and the conductive line includes a first conductive line and a second conductive line which extend in different directions to intersect each other.

(4) The film antenna according to the above (3), wherein the first dummy line and the first conductive line extend in the same direction, and the second dummy line and the second conductive line extend in the same direction.

(5) The film antenna according to the above (2), wherein a ratio of a width of the dummy line relative to a spacing distance between the dummy line and the antenna pattern is from 0.5 to 3.

(6) The film antenna according to the above (2), wherein the conductive line includes a plurality of conductive lines, and the antenna pattern further includes a boundary pattern connecting end portions of the plurality of conductive lines with each other.

(7) The film antenna according to the above (1), wherein the antenna pattern includes a radiation pattern, a pad and a transmission line that connects the radiation pattern and the pad with each other.

(8) The film antenna according to the above (7), wherein the radiation pattern and the pad include the mesh structure.

(9) The film antenna according to the above (7), wherein the radiation pattern includes the mesh structure, and the pad has a solid structure.

(10) The film antenna according to the above (1), wherein the dummy pattern includes a cut portion in at least a partial region thereof.

(11) A film antenna, including: a dielectric layer; and electrode lines including first electrode lines and second electrode lines, wherein the first electrode lines and the second electrode lines cross each other on a top surface of the dielectric layer to form a mesh structure, wherein the mesh structure includes an antenna pattern and a dummy pattern which are divided by a slit successively formed at some of intersecting portions of the first electrode lines and the second electrode lines.

(12) The film antenna according to the above (11), wherein the slit is a space formed from a cut intersecting portion of the intersecting portions.

(13) The film antenna according to the above (12), wherein the cut intersecting portion includes residual portions defining the slit therebetween,

(14) The film antenna according to the above (13), wherein the first electrode lines and the second electrode lines included in each boundary of the antenna pattern and the dummy pattern are connected to each other by the residual portions

(15) The film antenna according to the above (13), wherein each of the residual portions includes a concave portion opposite to the slit, and the concave portion has an internal angle larger than an intersecting angle of one of the first electrode lines and one of the second electrode lines.

(16) The film antenna according to the above (13), wherein each of the residual portions has a curved surface that is concave toward to the slit.

(17) The film antenna according to the above (11), wherein a width of the slit is larger than a width of each of the electrode lines.

(18) The film antenna according to the above (17), wherein a width of each of the intersecting portions is larger than a sum of the width of each of the electrode lines and the width of the slit.

(19) The film antenna according to the above (11), further including a ground layer formed on a bottom surface of the dielectric layer.

(20) A display device including the film antenna according to embodiments as described above.

According to some embodiments of the present invention, the film antenna may include an antenna pattern and a dummy pattern formed around the antenna pattern. The antenna pattern and the dummy pattern may each include substantially the same mesh structure. Accordingly, a visual recognition of the antenna pattern or electrodes due to optical and physical deviations may be prevented, and degradation of an image quality of the display device to which the film antenna is employed may be also prevented. Additionally, optical properties may be improved by the dummy pattern, and thus the antenna pattern may be formed of a low resistance metal to further increase signal transmission and reception properties.

According to some embodiments of the present invention, the film antenna may include a mesh structure formed by first electrode lines and second electrode lines intersecting each other. Thus, transmittance of the film antenna may be enhanced.

The mesh structure may be divided into the antenna pattern and the dummy pattern. The antenna pattern and the dummy pattern may be divided by slits formed by partially removing an intersecting portion of the first electrode lines and the second electrode lines.

The intersecting portion may be partially removed to form a residual portion, and the first and second electrode lines included in each of the antenna pattern and the dummy pattern may be connected to each other by the residual portion. Thus, resistance increase and signal loss of the antenna pattern due to the slits may be reduced or avoided.

The film antenna may have an improved transmittance, and may be applied to a display device including a mobile communication device capable of transmitting/receiving at high-frequency or ultra-high frequency bands of 3G, 4G, 5G or more to also improve radiation properties and optical properties such as transmittance.

DETAILED DESCRIPTION OF THE EMBODIMENTS

According to exemplary embodiments of the present invention, there is provided a film antenna including an antenna pattern and a dummy pattern which have a mesh structure on a dielectric layer and having improved transmittance.

The film antenna may be, e.g., a microstrip patch antenna fabricated as a transparent film. The film antenna may be applied to a communication device for high or ultra-high frequency band (e.g., 3G, 4G, 5G or more) mobile communications.

According to exemplary embodiments of the present invention, there is provided a display device including the film antenna. The film antenna may be also applied to various devices or objects such as an automobile, a home electronic device, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
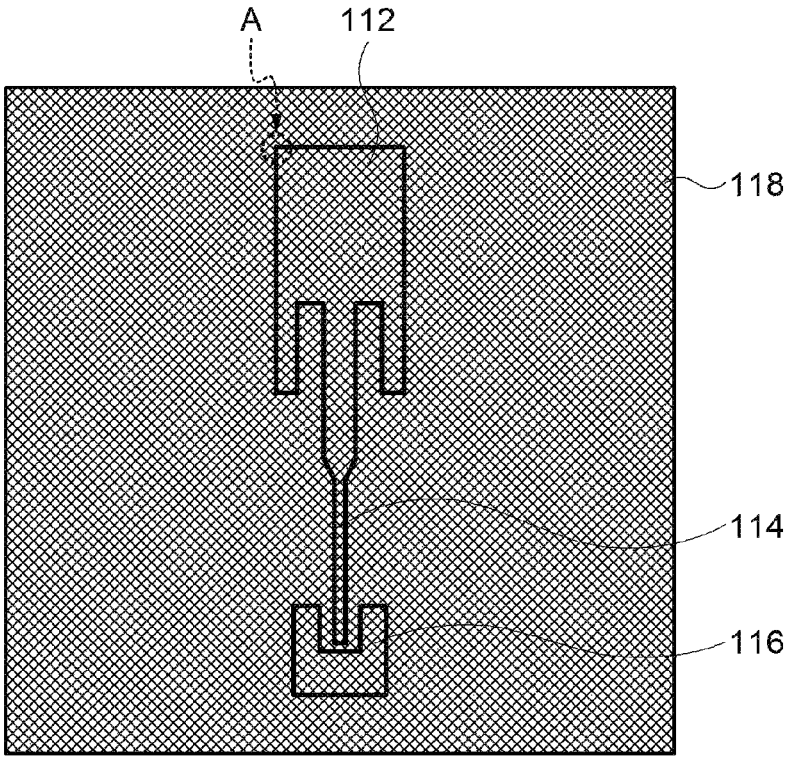
FIGS. 1 and 2 are a schematic top planar view and a schematic cross-sectional view, respectively, illustrating a film antenna in accordance with exemplary embodiments.
Figure 2:
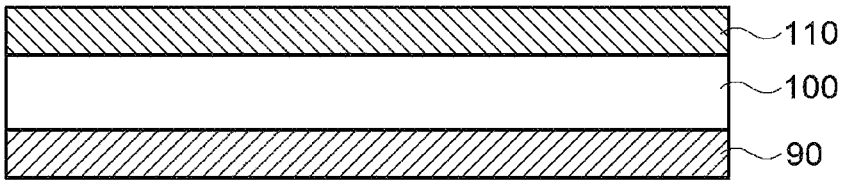

Referring to FIGS. 1 and 2, the film antenna may include an antenna pattern and a dummy pattern 118 disposed on a dielectric layer 100. In exemplary embodiments, the antenna pattern may include a radiation pattern 112, a transmission line 114 and a pad 116.

The dielectric layer 100 may include an insulation material having a predetermined dielectric constant. The dielectric layer 100 may include, e.g., an inorganic insulating material such as glass, silicon oxide, silicon nitride and a metal oxide, or an organic insulating material such as an epoxy resin, an acrylic resin, an imide-based resin, a cellulose-based resin, a polyolefin-based resin, a urethane-based resin, a vinyl alcohol-based resin, etc. The dielectric layer 100 may function as a film substrate of a film antenna on which the antenna pattern is formed.

In some embodiments, the dielectric layer 100 may include an adhesive film including a pressure-sensitive adhesive (PSA) or an optically clear adhesive (OCA).

In some embodiments, a dielectric constant of the dielectric layer 100 may be adjusted in a range from about 1.5 to about 12. If the dielectric constant exceeds about 12, a driving frequency may be excessively reduced and an antenna driving in a desired high frequency or ultra-high frequency band may not be obtained.

The antenna pattern may include the radiation pattern 112, the transmission line 114 and the pad 116.

The radiation pattern 112 may be integrally connected with the transmission line 114. For example, the radiation pattern 112 may include a protrusion connected to the transmission line 114 in a central portion thereof. However, the shape of the radiation pattern 112 illustrated in FIG. 1 may be appropriately changed in consideration of radiation efficiency, etc.

The transmission line 114 may serve as, e.g., a feeding line of the antenna pattern. The transmission line 114 may extend from the protrusion of the radiation pattern 112 to the pad 116.

As illustrated in FIG. 1, the pad 116 may include a recess therein, and the transmission line 114 may be inserted into the recess of the pad 116.

A dummy pattern 118 may be arranged around the antenna pattern. The dummy pattern 118 may be disposed at the same layer or at the same level as that of the antenna pattern on a top surface of the dielectric layer 100.

In exemplary embodiments, the dummy pattern 118 and the antenna pattern may include a mesh structure having substantially the same shape. In some embodiments, the dummy pattern 118 and the antenna pattern may be formed from substantially the same mesh layer, such that an area of each cell included in the mesh structure, and a width and a height of a conductive line may be substantially the same in the dummy pattern 118 and the antenna pattern.

As illustrated in FIG. 2, a first conductive layer 110 may be disposed on the dielectric layer 100, and the first conductive layer 110 may include the antenna pattern and the dummy pattern 118 as described above.

The first conductive layer 110 (the antenna pattern and the dummy pattern 118) may include the mesh structure as described above, and thus transmittance of the film antenna may be improved. Additionally, the antenna pattern and the dummy pattern 118 may include substantially the same mesh structure so that a pattern visibility phenomenon caused by a regional variation and reflectance difference of a pattern shape in the first conductive layer 110 may be prevented.

In exemplary embodiments, the antenna pattern may include a low resistance metal. The above-described mesh structure may be included in the antenna pattern and the dummy pattern 118 to achieve improved transmittance and optical properties. Thus, signal loss of the antenna pattern may be reduced and radiation properties may be improved by using the metal instead of a transparent metal oxide (e.g., ITO or IZO) having a relatively high resistance.

For example, the antenna pattern may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), molybdenum (Mo), calcium (Ca) or an alloy thereof. These may be used alone or in combination thereof. For example, the antenna pattern may be formed of silver (Ag) or a silver alloy (e.g., silver-palladium-copper (APC) alloy), or copper or a copper alloy (e.g., a copper-calcium (CuCa) alloy) for implementing a low resistance and a fine line width.

In an embodiment, the antenna pattern may consist essentially of the metal and/or the alloy.

The dummy pattern 118 may also include a metal or an alloy substantially the same as that of the antenna pattern.

A thickness of the first conductive layer 110 may be adjusted in consideration of low resistance and an improved transmittance of the antenna pattern. For example, the thickness of the first conductive layer 110 may range from about 100 Å to about 5,000 Å. As described above, the antenna pattern and the dummy pattern 118 may have substantially the same thickness (or the same height).

A second conductive layer 90 may be disposed under the dielectric layer 100. In exemplary embodiments, the second conductive layer 90 may serve as a ground electrode of the film antenna. In this case, a contact or a connection ground pattern connecting the second conductive layer 90 and the pad 116 may be formed in the dielectric layer 100.

In some embodiments, the second conductive layer 90 may be included as an individual element of the film antenna. In some embodiments, a conductive member of the display device to which the film antenna is employed may serve as a ground layer.

The conductive member may include, e.g., a gate electrode of a thin film transistor (TFT), various wirings such as a scan line or a data line, various electrodes such as a pixel electrode and a common electrode, etc., included in a display panel.

The second conductive layer 90 may include a conductive material such as a metal, an alloy, a transparent metal oxide, etc.

In some embodiments, the antenna pattern may be a vertical radiation pattern. In an embodiment, the antenna pattern may include a horizontal radiation pattern. In this case, the ground layer may be disposed at the same level as that of the radiation pattern 112 (e.g., on the top surface of the dielectric layer 100).

For convenience of descriptions, only one antenna pattern is illustrated in FIG. 1. However, a plurality of the antenna patterns may be regularly or randomly arranged on the dielectric layer 100.

Figure 3:
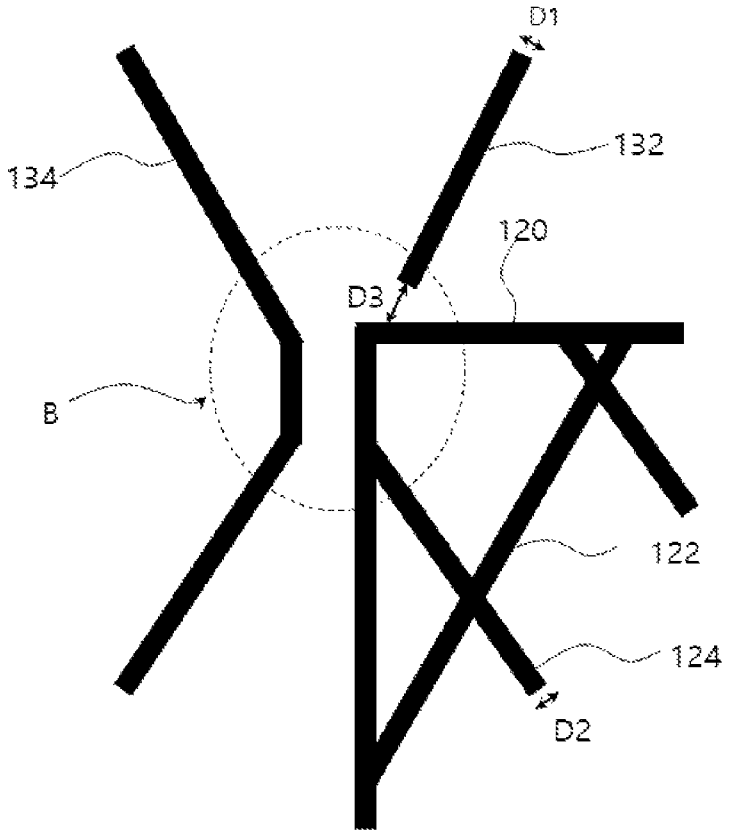
FIG. 3 is a partially enlarged view illustrating an electrode line construction of a film antenna in accordance with exemplary embodiments.

FIG. 3 is a partially enlarged view illustrating an electrode line construction of a film antenna in accordance with exemplary embodiments. For example, FIG. 3 is a partially enlarged view of a region designated as "A" in FIG. 3.

Referring to FIG. 3, the mesh structure included in the antenna pattern (or the radiation pattern 112) may include conductive lines. The conductive lines may include first conductive lines 122 and second conductive lines 124.

The first conductive line 122 and the second conductive line 124 may extend in different directions, and the first conductive lines 122 and the second conductive lines 124 may intersect each other to define a plurality of cells.

In some embodiments, a boundary pattern 120 defining the antenna pattern or the radiation pattern 112 may be formed. End portions of the first conductive lines 122 and the second conductive lines 124 included in the radiation pattern 112 may be substantially merged or connected by the boundary pattern 120 so that resistance and signal loss of the radiation pattern 112 may be further reduced.

The mesh structure included in the dummy pattern 118 may include dummy lines. The dummy lines may include first dummy lines 132 and second dummy lines 134 that may intersect or cross each other.

In exemplary embodiments, the first conductive line 122 and the first dummy line 132 may extend in substantially the same direction. The first conductive line 122 and the first dummy line 132 may have the same width and the same height.

The second conductive line 124 and the second dummy line 134 may extend in substantially the same direction, and may have the same width and the same height.

In exemplary embodiments, the first and second conductive lines 122 and 124 and the first and second dummy lines 132 and 134 may include substantially the same metal.

As described above, the antenna pattern and the dummy pattern 118 may include the mesh structure including substantially the same pattern shape and material, and thus, pattern visibility may be reduced while improving transmittance.

The boundary pattern 120 may extend in different directions from those of the conductive lines 122 and 124 and the dummy lines 132 and 134. Accordingly, a signal flow to the dummy pattern 118 may be blocked to suppress signal/radiation interference between the antenna pattern and the dummy pattern.

As illustrated in FIG. 3, a width of the dummy line may be indicated as "D1", and a width of the conductive line of the antenna pattern may be indicated as "D2".

The dummy line and the antenna pattern may be separated from each other to block signal interference. In some embodiments, a separation region B may be formed at an intersecting portion of the conductive line and the dummy line. A spacing distance between the antenna pattern and the dummy line in the separation region B may be indicated as "D3".

In some embodiments, a spacing distance D3 may be a distance between the dummy line 132 and 134, and the boundary pattern 120 included in the antenna pattern, or a cut distance of the dummy line 132 and 134 and the conductive line 122 and 124.

The spacing distance D3 may be a distance measured along an extending direction of the first dummy line 132 or the second dummy line 134.

In exemplary embodiments, a ratio D1/D3 of the width D1 of the dummy line relative to the spacing distance D3 may range from about 0.5 to about 3. The width D1 of the dummy line and the width D2 of the conductive line may be the same.

If the ratio is less than about 0.5, radiation properties may be deteriorated and a space between the dummy line and the antenna pattern may be increased to cause a visual recognition of patterns. If the ratio exceeds about 3, a thickness of the dummy line or the conductive line may be excessively increased, and the visual recognition of patterns may be also caused.

In exemplary embodiments, the boundary pattern 120 may be included so that the spacing distance D3 may be further reduced. Thus, the distance between the dummy pattern and the antenna pattern may be reduced to further suppress the pattern visibility.

FIG. 3 illustrates that the dummy line and the conductive line each extends in a linear shape. However, the dummy line and the conductive line may extend in various shapes, e.g., a wavy shape, a sawtooth shape, etc.

Figure 4:
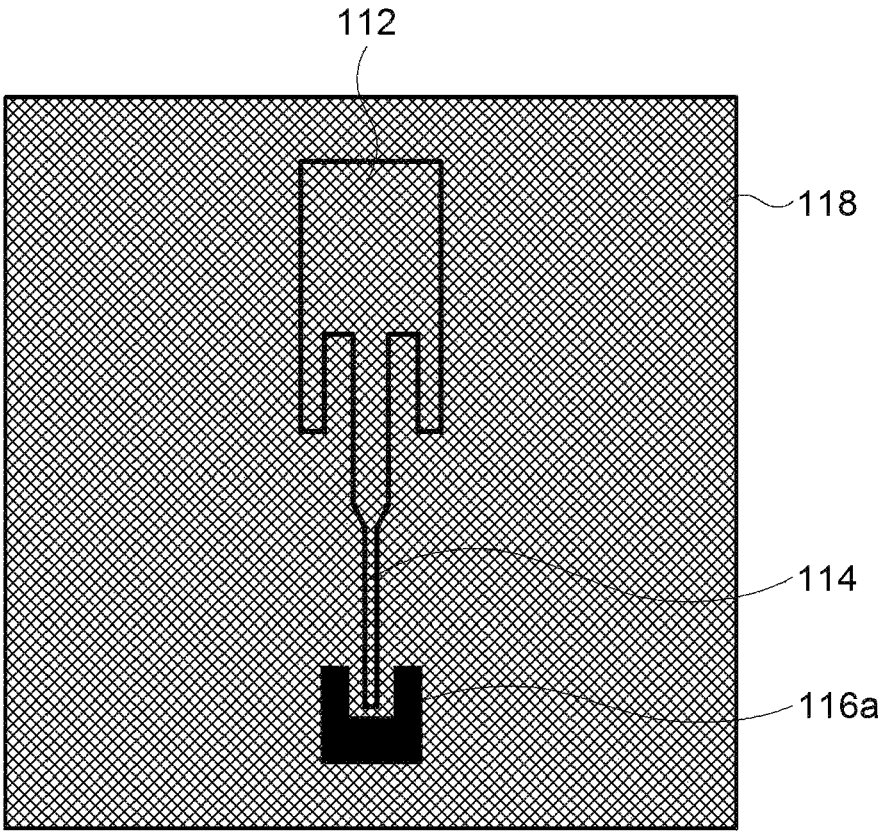
FIGS. 4 and 5 are a schematic top planar view and a schematic cross-sectional view, respectively, illustrating a film antenna in accordance with some exemplary embodiments.
Figure 5:
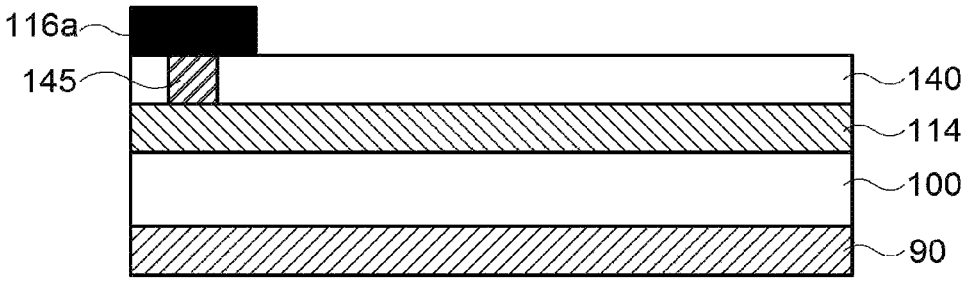

FIGS. 4 and 5 are a schematic top planar view and a schematic cross-sectional view, respectively, illustrating a film antenna in accordance with some exemplary embodiments. Detailed descriptions on elements and constructions substantially the same as or similar to those described with reference to FIGS. 1 and 2 are omitted herein.

Referring to FIGS. 4 and 5, a pad 116*a* included in the antenna pattern may have a substantially solid structure. In this case, the radiation pattern 112 may be formed of a mesh structure to enhance transmittance and optical properties, and the pad 116*a* may be formed as the solid structure to provide high signal sensitivity and low resistance.

For example, the pad 116*a* may be disposed at a peripheral portion or a bezel portion of a display device and may not substantially affect a display image.

In some embodiments, the pad 116*a* may be disposed at a different level or at a different layer from that of the radiation pattern 112. As illustrated in FIG. 5, an insulation layer 140 may be formed on the radiation pattern 112 and the transmission line 114, and the pad 116*a* may be disposed on the insulation layer 140.

A contact portion 145 electrically connecting the pad 116*a* and the transmission line 114 may be formed in the insulation layer 140.

Figure 6:
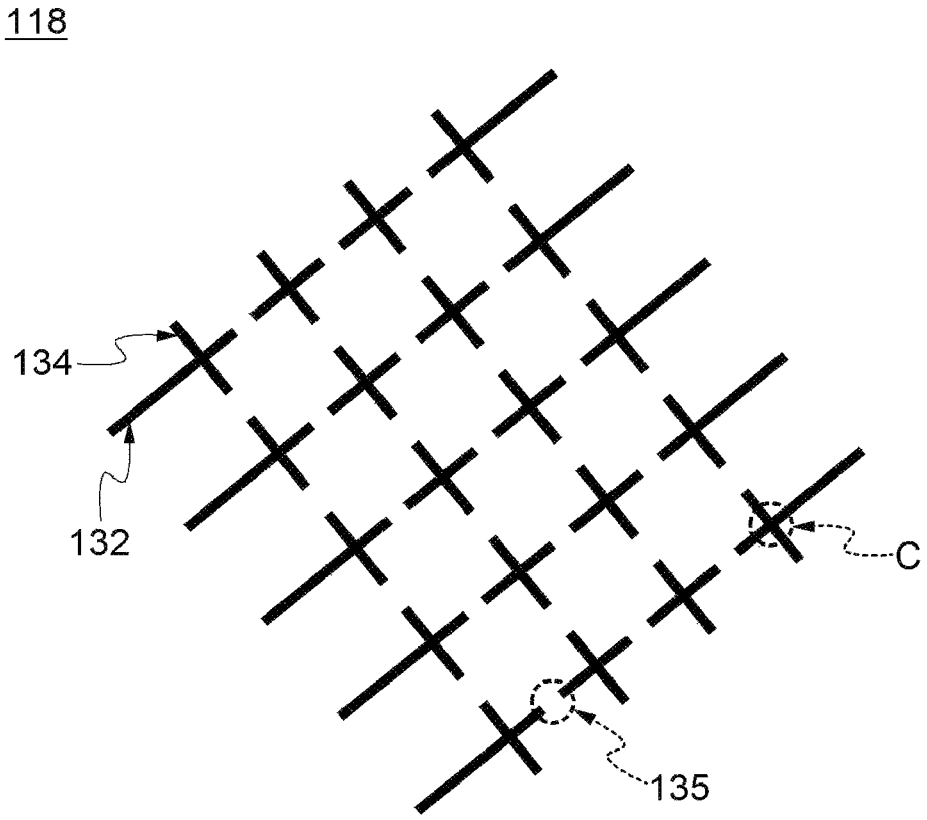
FIGS. 6 to 8 are schematic top planar views illustrating a dummy pattern structure of a film antenna in accordance with exemplary embodiments.
Figure 7:
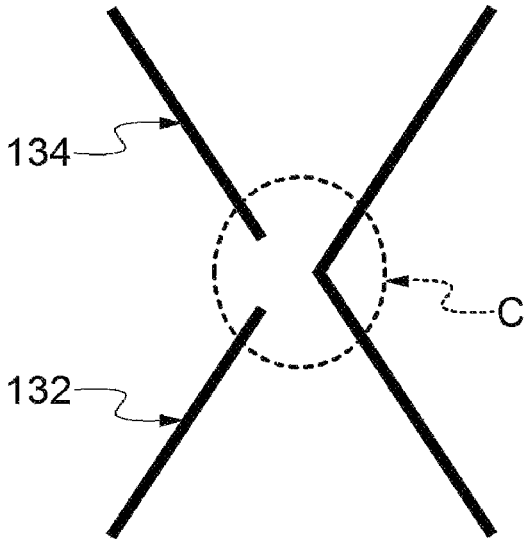
Figure 8:
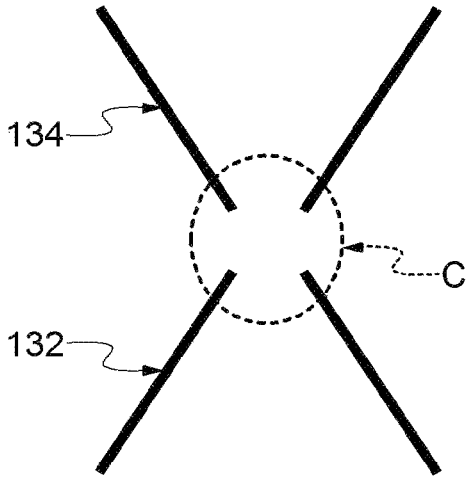

FIGS. 6 to 8 are schematic top planar views illustrating a dummy pattern structure of a film antenna in accordance with exemplary embodiments.

In some embodiments, a mesh structure of the dummy pattern 118 may include a cut portion 135 formed in at least a portion thereof to prevent radiation and signal interference with the antenna pattern.

Referring to FIG. 6, e.g., the cut portion 135 may be formed in a side of each cell in the dummy pattern 118.

Referring to FIGS. 7 and 8, the cut portion may be formed at an intersecting region (the region designated as "C" in FIG. 6) of the dummy lines 132 and 134.

As illustrated in FIG. 7, the dummy lines 132 and 134 may be partially cut at the intersecting region C to form the cut portion.

As illustrated in FIG. 8, the dummy lines 132 and 134 may be entirely cut at the intersecting region C to form the cut portion.

In an embodiment, the above-described cut portions may be distributed in some regions of the dummy pattern 118. For example, the cut portions may be distributed in an area adjacent to the antenna pattern of the dummy pattern 118 to suppress radiation and signal disturbance of the antenna pattern by the dummy pattern 118.

Figure 9:
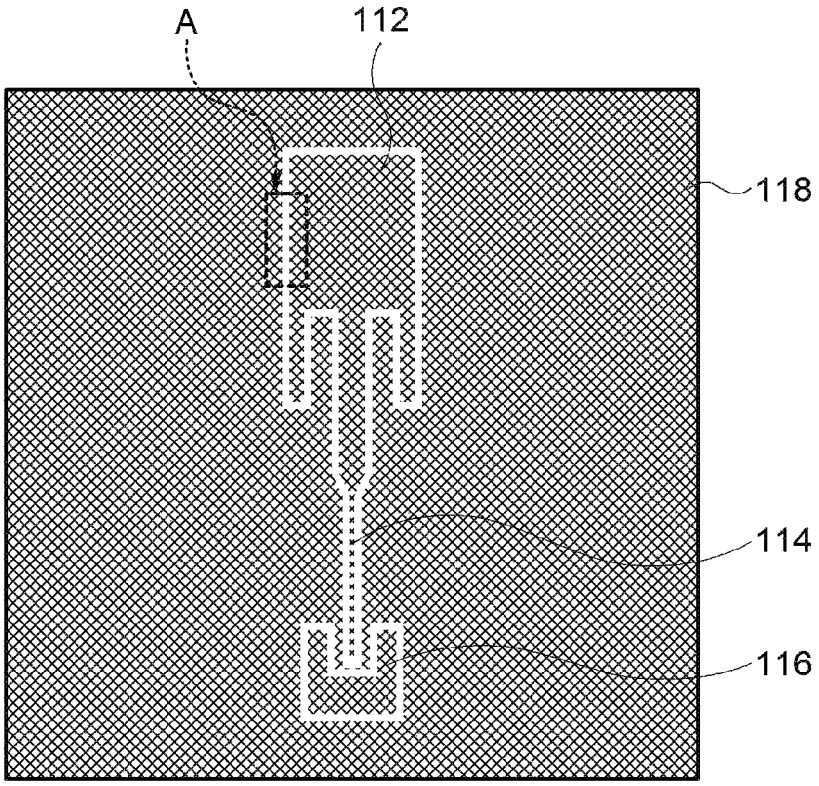
FIG. 9 is a schematic top planar view illustrating a film antenna in accordance with exemplary embodiments.

FIG. 9 is a schematic top planar view illustrating a film antenna in accordance with exemplary embodiments. Detailed descriptions on elements and/or materials substantially the same as or similar to those described with reference to FIGS. 1 and 2 are omitted herein. Like reference numerals are used to designate like elements.

Referring to FIG. 9, as described above, the film antenna may include the antenna pattern and the dummy pattern 118 disposed on the dielectric layer 100. The antenna pattern may include the radiation pattern 112, the transmission line 114, and the pad 116.

In exemplary embodiments, the dummy pattern 118 and the antenna pattern may include a mesh structure having substantially the same shape. In some embodiments, the dummy pattern 118 and the antenna pattern may be formed from substantially the same mesh layer, and thus an area of each cell included in the mesh structure, a width and a height of an electrode line may be the same in the dummy pattern 118 and the antenna pattern. The mesh layer may be partially patterned or cut to form a cut region A, and the dummy pattern and the antenna pattern may be physically and electrically separated from each other by the cut region A.

In some embodiments, as described with reference to FIGS. 4 and 5, the pad 116 may have a solid structure and may be disposed at a different level or at a different layer from that of the radiation pattern 112.

Figure 10:
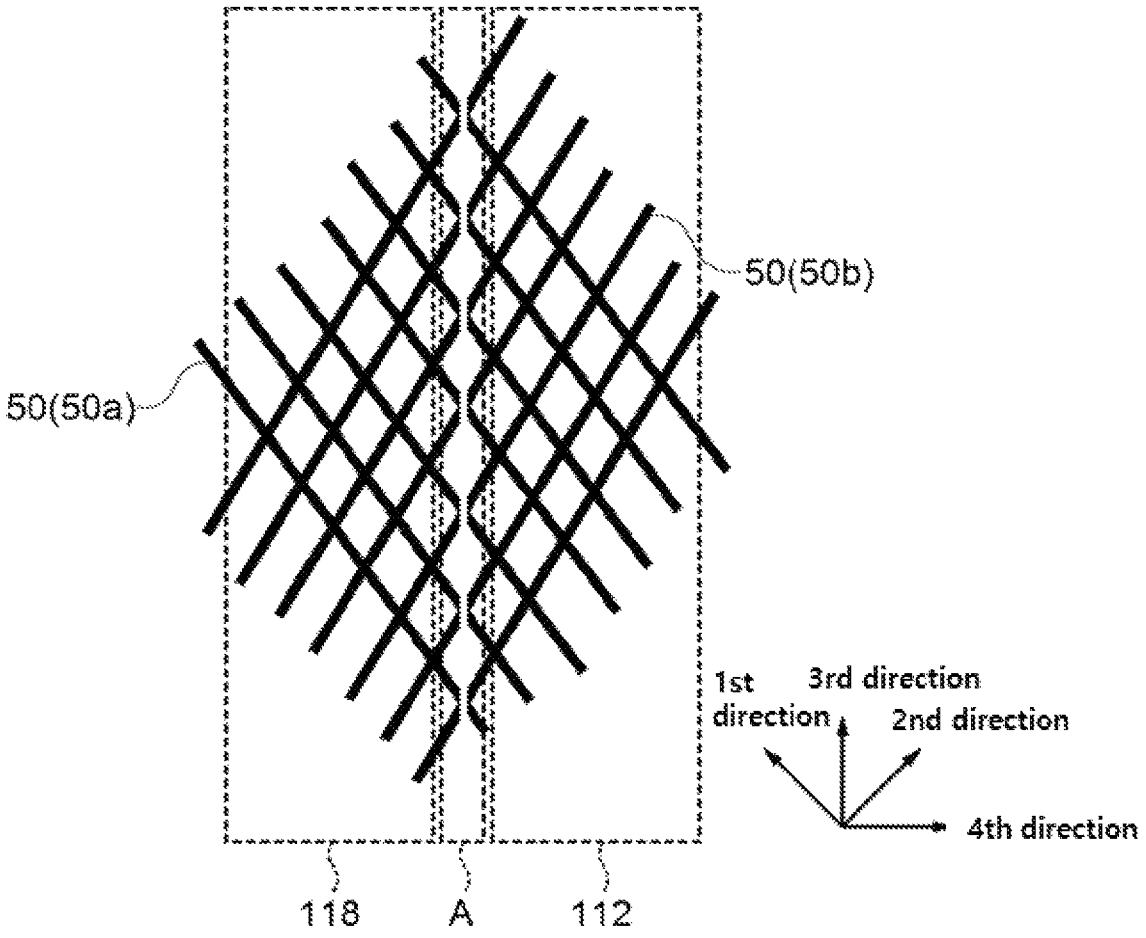
FIG. 10 is a partially enlarged view illustrating an electrode line construction of a film antenna in accordance with exemplary embodiments.

FIG. 10 is a partially enlarged view illustrating an electrode line construction of a film antenna in accordance with exemplary embodiments. For example, FIG. 10 illustrates an electrode line construction around the cut region A of FIG. 9.

Referring to FIG. 10, a plurality of electrode lines 50 may be arranged on the dielectric layer 100 to form a mesh structure, and the mesh structure may be divided by the cut region A to define the radiate pattern 112 and the dummy pattern 118.

The electrode lines 50 may include first electrode lines 50*a* and second electrode lines 50*b* extending in diagonal directions crossing or intersecting each other. For example, as illustrated in FIG. 10, the first electrode line 50*a* and the second electrode line 50*b* may extend in the first direction and the second direction, respectively. A plurality of the first electrode lines 50*a* may be arranged along the second direction, and a plurality of second electrode lines 50*b* may be arranged along the first direction to form the mesh structure.

Hereinafter, a length direction and a width direction of the antenna pattern included in the film antenna are defined as a third direction and a fourth direction, respectively. The first and second directions may extend diagonally relative to the third direction by predetermined acute angles.

The cut region A may extend in the third direction while cutting intersecting portions of the first and second electrode lines. The dummy pattern 118 and the antenna pattern (e.g., the radiation pattern 112) may be defined from the mesh structure by the cut region A. The cut region A may also extend in the fourth direction as illustrated in FIG. 9 and may cut the intersecting portions to define the antenna pattern.

The dummy pattern 118 and the antenna pattern may be separated by the cut region A so that the antenna pattern may be defined without forming am additional boundary pattern. Accordingly, a visual recognition of the electrode caused by the boundary pattern may be prevented.

Figure 11:
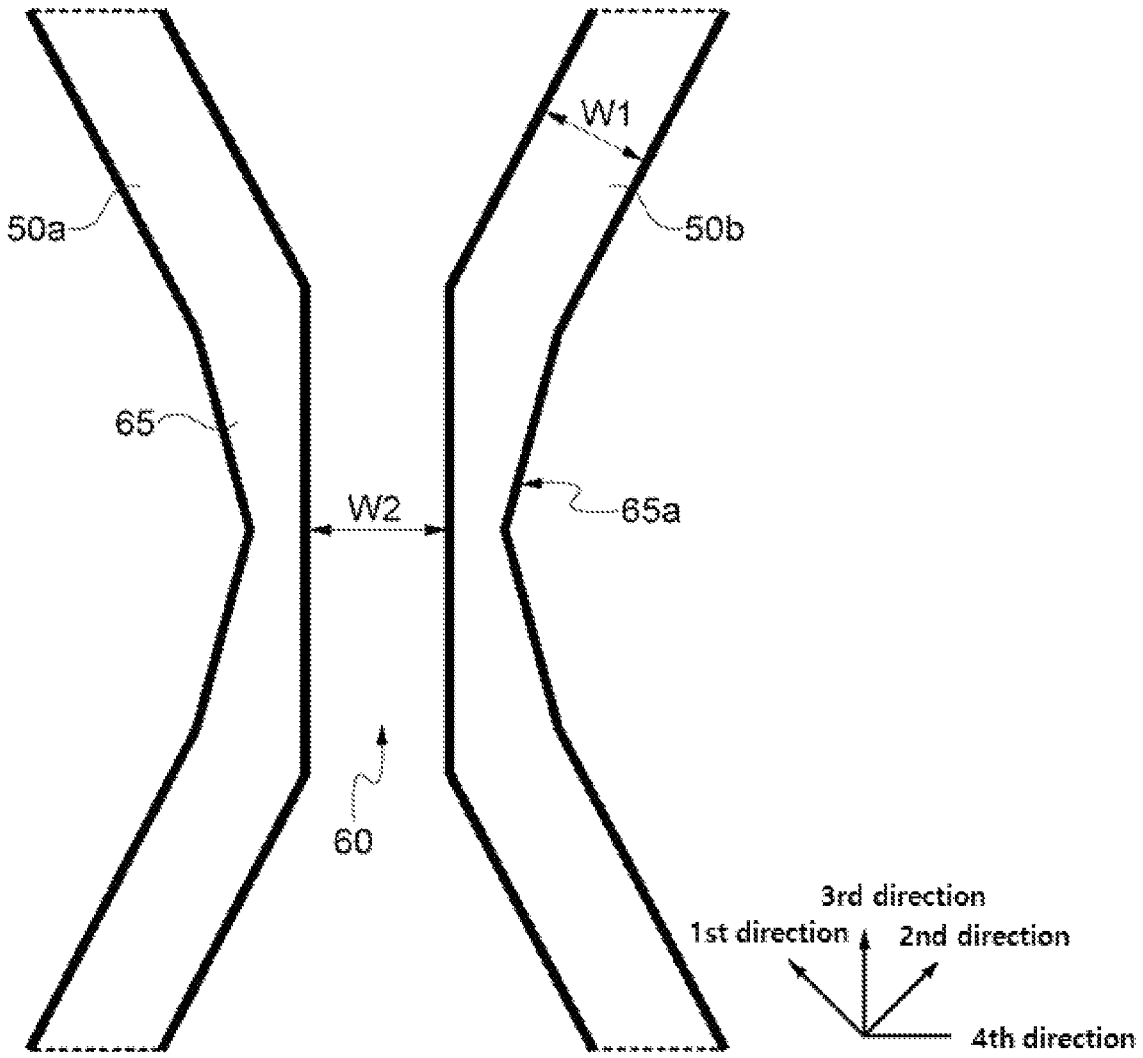
FIG. 11 is a partially enlarged view illustrating an interesting portion of a film antenna in accordance with exemplary embodiments.

FIG. 11 is a partially enlarged view illustrating an interesting portion of a film antenna in accordance with exemplary embodiments.

Referring to FIG. 11, a slit 60 may be formed by partially removing the intersecting portion of the first electrode line 50*a* and the second electrode line 50*b*. As described above, the slits 60 may be formed along the third direction and/or the fourth direction to form the cut region A and define the antenna pattern.

A portion of the intersection portion except for a portion removed as the slit 60 may be defined as a residual portion 65. In exemplary embodiments, two separate residual portions 65 may be created from one intersecting portion when the slit 60 is formed. The first and second electrode lines 50*a* and 50*b* included in the antenna pattern and the dummy pattern 118 may be connected to each other by each residual portion 65. Accordingly, even though the cut region A is formed, the electrode lines 50*a* and 50*b* around the cut region A may be connected with each other by the residual portion 65 to prevent signal loss due to a resistance increase in the antenna pattern.

In some embodiments, an opposite side of the residual portion 65 relative to the slit 60 may include a concave portion 65*a*. For example, the concave portion 65*a* may be inclined by an internal angle greater than an intersecting angle of the electrode lines 50*a* and 50*b* or between the first direction and the second direction.

A pattern variation of the electrode lines 50*a* and 50*b* due to the intersecting portion or the intersecting angle may be buffered by the concave portion 65*a* so that the electrode visibility at the intersecting portion may be further reduced. Additionally, an etchant concentration at the intersection portion may be reduced so that over-etching damages at the intersecting portion may be also prevented. Further, moiré phenomenon caused by an overlap with the display panel disposed under the film antenna may be reduced or prevented by the concave portion 65*a*.

In an embodiment, the side of the concave portion 65*a* may have a curved surface.

In some embodiments, a width W1 of each of the first and second electrode lines may be from about 1 μm to about 7 μm. A width W2 of the slit 60 may be greater than the width W1 of the electrode line.

If the width W2 of the slit 60 is smaller than the width W1 of the electrode line, a spacing distance between the dummy pattern 118 and the antenna pattern may decrease to cause an increase of signal noise. If the width W2 of the slit 60 is excessively increased, a width of the cut region A is excessively increased to cause the visual recognition of electrodes. For example, the width W2 of the slit 60 may be from about 1.5 μm to 3.5 μm.

Figure 12:
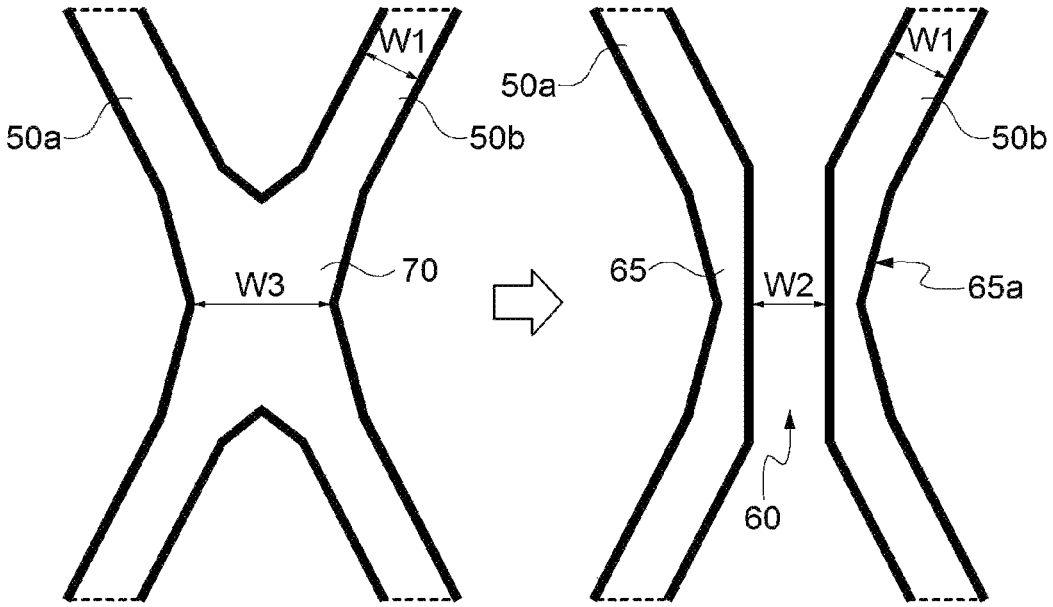
FIG. 12 is a partially enlarged view illustrating a formation of a slit in a film antenna in accordance with exemplary embodiments.

FIG. 12 is a partially enlarged view illustrating a formation of a slit in a film antenna in accordance with exemplary embodiments.

Referring to FIG. 12, an intersecting portion 70 may be formed in an intersecting region of the first electrode line 50*a* and the second electrode line 50*b*. As described with reference to FIG. 11, the slit 60 may be formed to have a width larger than the width W1 of the electrode line, and thus the intersecting portion 70 may be formed to have a sufficient width in consideration of the formation of the slit 60.

In some embodiments, a width W3 of the intersecting portion 70 may be greater than a sum of the width W1 of the electrode line and the width W2 of the slit 60. In some embodiments, the width W3 of the intersecting portion 70 may be about 1.5 to 5 times the width W1 of the electrode line, preferably 2 to 5 times the width W1 of the electrode line in consideration of the slit 60 and the residual portion 65.

Subsequently, an etching process may be performed to form the cut region A, so that the intersecting portion 70 may be partially removed and the slit 60 having the predetermined width W2 may be formed. The residual portion 65 may formed by remaining portions of the intersecting portion 70 after forming the slit 60 to connect the first and second electrode lines 50*a* and 50*b* to each other. The residual portion 65 may include the concave portion 65*a* as described above.

Figure 13:
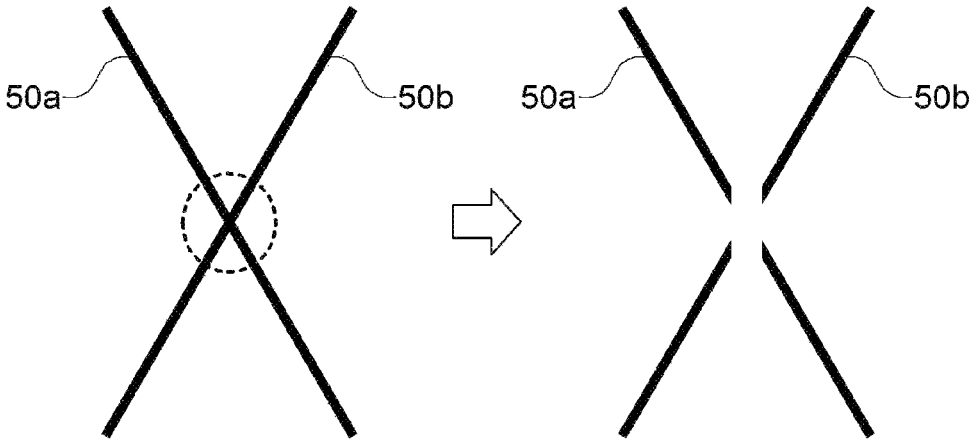
FIG. 13 is a partially enlarged view illustrating a formation of a slit in a film antenna in accordance with a comparative example.

FIG. 13 is a partially enlarged view illustrating a formation of a slit in a film antenna in accordance with a comparative example.

Referring to FIG. 13, when the electrode lines 50*a* and 50*b* intersect while maintaining original form thereof without a change of the width in the intersecting region (indicated by a the dotted circle), the electrode lines 50*a* and 50*b* in the intersecting region may be wholly cut or removed by an etching process for the formation of the cut region.

In this case, the number of the cut regions may be increased to cause a pattern variation and also generate the visual recognition of electrodes. Further, the electrode lines 50*a* and 50*b* included in a boundary of the antenna pattern are all separated to cause a signal loss due to resistance increase.

However, according to exemplary embodiments as described above, the intersecting portion 70 may have the sufficient width so that the residual portions 65 and the slit 60 between the residual portions 65 may be formed when forming the cut region A. Thus, the electrode recognition and the resistance increase that may be caused in the comparative example may be prevented or reduced.

Figure 14:
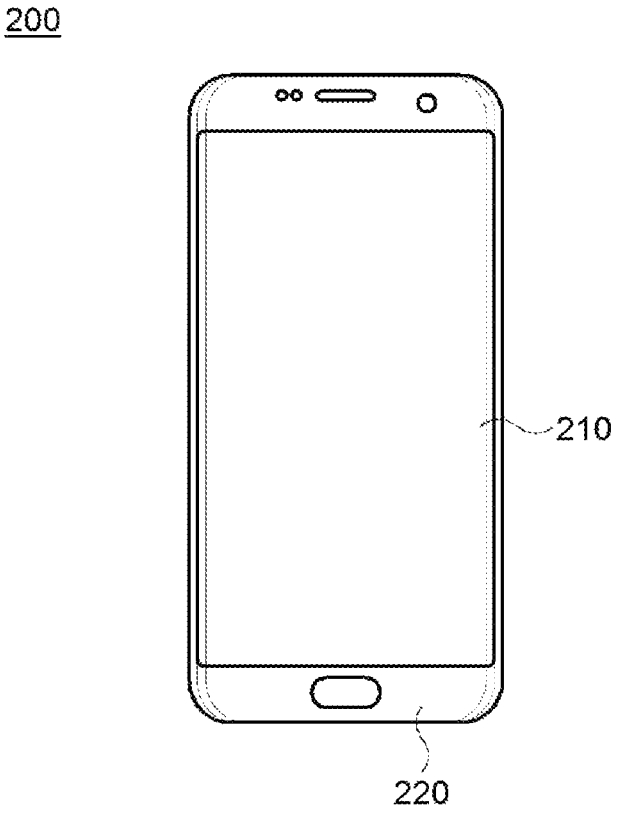
FIG. 14 is a schematic top planar view illustrating a display device in accordance with exemplary embodiments.

FIG. 14 is a schematic top planar view illustrating a display device in accordance with exemplary embodiments.

For example, FIG. 14 illustrates an outer shape including a window of a display device.

Referring to FIG. 14, a display device 200 may include a display region 210 and a peripheral region 220. The peripheral region 220 may be positioned, e.g., at both lateral portions and/or both end portions of the display region 210.

In some embodiments, the above-described film antenna may be inserted into the display device 200 as a patch. In some embodiments, the antenna pattern of the film antenna may be entirely covered by the display area 210 of the display device 200. In some embodiments, the radiation pattern 112 of the antenna pattern may overlap the display region 210, and the pad 116 and 116*a* may be disposed to correspond to the peripheral region 220.

The peripheral region 220 may correspond to, e.g., a light-shielding portion or a bezel portion of the display device. A driving circuit unit such as an IC chip of the display device 200 and/or the film antenna may be disposed to correspond to the peripheral region 220 of the display device 200.

The pad 116 and 116*a* of the film antenna may be adjacent to the driving circuit unit so that a signaling path may become shorter to suppress signal loss.

Hereinafter, preferred embodiments are proposed to more concretely describe the present invention. However, the following examples are only given for illustrating the present invention and those skilled in the related art will obviously understand that these examples do not restrict the appended claims but various alterations and modifications are possible within the scope and spirit of the present invention. Such alterations and modifications are duly included in the appended claims.

Experimental Example: Measuring Optical Properties and Signal Loss According to Spacing Distance Between a Dummy Line and an Antenna Pattern An silver-palladium-copper (APC) mesh structure having an area of 50 mm*50 mm and a line width of 3 μm was formed on a cyclo olefin polymer (COP) substrate. The mesh structure was cut or patterned to divide an antenna pattern and a dummy line. A spacing distance between the dummy line and the antenna pattern was changed to change a ratio D1/D3 (see FIG. 3).

Film antenna samples were prepared while changing the ratios D1/D3. The film antenna samples were observed by naked eyes of 100 professional sensory testing panels to evaluate visibility of the antenna pattern. The number of the 100 panels who determine that the antenna pattern was visually recognized was used as a standard of the pattern visibility, and the results are shown in Table 1 below.

Further, S-parameter was extracted at 28 GHz using Network analyzer to evaluate a return loss of each sample. The results are also shown in Table 1 below.

TABLE 1

| | Spacing Distance (μm) | D1/D3 | Pattern Visibility (number of panels) | Return loss S11 (dB) |
|---|---|---|---|---|
| Sample 1 | 1.0 | 3 | 0 | −15.3 |
| Sample 2 | 2.0 | 1.5 | 1 | −16.0 |
| Sample 3 | 3.0 | 1 | 3 | −17.5 |
| Sample 4 | 4.0 | 0.75 | 6 | −17.9 |
| Sample 5 | 5.0 | 0.6 | 10 | −18.2 |
| Sample 6 | 6.0 | 0.5 | 12 | −18.6 |
| Sample 7 | 7.0 | 0.43 | 42 | −19.0 |
| Sample 8 | 10.0 | 0.3 | 63 | −19.0 |
| Sample 9 | 12.0 | 0.25 | 80 | −19.5 |
| Sample 10 | 15.0 | 0.2 | 90 | −19.6 |
| Sample 11 | 20.0 | 0.15 | 94 | −20.0 |

Referring to Table 1 above, when the ratio D1/D3 was in a range from about 0.5 to about 3 (Samples 1-6), the visibility of the antenna pattern was effectively avoided while sufficiently preventing return loss. When the ratio D1/D3 exceeded 0.5, the visibility of the antenna pattern was drastically increased.

What is claimed is:

1. A film antenna, comprising:

a dielectric layer;

an antenna pattern comprising a mesh structure on a top surface of the dielectric layer; and a dummy pattern on the top surface of the dielectric layer, the dummy pattern comprising the same mesh structure as that of the antenna pattern, wherein the dummy pattern includes a dummy line, and the antenna pattern includes a conductive line; and a ratio of a width of the dummy line relative to a spacing distance between the dummy line and the antenna pattern is from 0.5 to 3.

2. The film antenna according to claim 1, wherein the dummy line and the conductive line have the same width and the same height.

3. The film antenna according to claim 2, wherein the dummy line comprises a first dummy line and a second dummy line which extend in different directions to intersect each other; and the conductive line comprises a first conductive line and a second conductive line which extend in different directions to intersect each other.

4. The film antenna according to claim 3, wherein the first dummy line and the first conductive line extend in the same direction, and the second dummy line and the second conductive line extend in the same direction.

5. The film antenna according to claim 2, wherein the conductive line comprises a plurality of conductive lines; and the antenna pattern further comprises a boundary pattern connecting end portions of the plurality of conductive lines with each other.

6. The film antenna according to claim 1, wherein the antenna pattern comprises a radiation pattern, a pad and a transmission line that connects the radiation pattern and the pad with each other.

7. The film antenna according to claim 6, wherein the radiation pattern and the pad comprises the mesh structure.

8. The film antenna according to claim 6, wherein the radiation pattern comprises the mesh structure, and the pad has a solid structure.

9. The film antenna according to claim 1, wherein the dummy pattern comprises a cut portion in at least a partial region thereof.

10. A display device comprising the film antenna according to claim 1.

11. A film antenna, comprising:

a dielectric layer; and electrode lines comprising first electrode lines and second electrode lines, wherein the first electrode lines and the second electrode lines cross each other on a top surface of the dielectric layer to form a mesh structure, wherein the mesh structure comprises an antenna pattern and a dummy pattern which are divided by a slit successively formed at some of intersecting portions of the first electrode lines and the second electrode lines, wherein the slit is a space formed from a cut intersecting portion of the intersecting portions; and the cut intersecting portion comprises residual portions defining the slit therebetween.

12. The film antenna according to claim 11, wherein the first electrode lines and the second electrode lines comprised in each boundary of the antenna pattern and the dummy pattern are connected to each other by the residual portions.

13. The film antenna according to claim 11, wherein each of the residual portions comprises a concave portion opposite to the slit, and the concave portion has an internal angle larger than an intersecting angle of one of the first electrode lines and one of the second electrode lines.

14. The film antenna according to claim 11, wherein each of the residual portions has a curved surface that is concave toward to the slit.

15. The film antenna according to claim 11, wherein a width of the slit is larger than a width of each of the electrode lines.

16. The film antenna according to claim 15, wherein a width of each of the intersecting portions is larger than a sum of the width of each of the electrode lines and the width of the slit.

17. The film antenna according to claim 11, further comprising a ground layer formed on a bottom surface of the dielectric layer.

18. A film antenna, comprising:

a dielectric layer;

an antenna pattern including a mesh structure on a top surface of the dielectric layer; and a dummy pattern on a top surface of the dielectric layer, the dummy pattern including the same mesh structure as that of the antenna pattern, wherein the antenna pattern includes a radiation pattern, a pad and a transmission line that connects the radiation pattern and the pad with each other.

19. The film antenna according to claim 18, wherein the radiation pattern and the pad includes the mesh structure.

20. The film antenna according to claim 18, wherein the radiation pattern includes the mesh structure, and the pad has a solid structure.

* * * * *